US011925877B2

(12) United States Patent
Wu

(10) Patent No.: US 11,925,877 B2
(45) Date of Patent: Mar. 12, 2024

(54) RELAY TOY FOR RECALLING LIFE COURSE

(71) Applicant: Shenzhen Polytechnic, Guangdong (CN)

(72) Inventor: Bo Wu, Guangdong (CN)

(73) Assignee: Shenzhen Polytechnic

( * ) Notice: Subject to any disclaimer, the term of this patent is extended or adjusted under 35 U.S.C. 154(b) by 211 days.

(21) Appl. No.: 17/702,370

(22) Filed: Mar. 23, 2022

(65) Prior Publication Data

US 2022/0314140 A1 Oct. 6, 2022

Related U.S. Application Data

(63) Continuation of application No. PCT/CN2020/118088, filed on Sep. 27, 2020.

(30) Foreign Application Priority Data

Sep. 27, 2019 (CN) ..... 201910930113.4

(51) Int. Cl.
*A63H 33/04* (2006.01)
*A63H 33/26* (2006.01)

(52) U.S. Cl.
CPC ..... *A63H 33/046* (2013.01); *A63H 33/26* (2013.01); *A63H 2200/00* (2013.01)

(58) Field of Classification Search
CPC .. A63H 33/046; A63H 33/26; A63H 2200/00; A63H 33/00
USPC ..... 446/458
See application file for complete search history.

(56) References Cited

U.S. PATENT DOCUMENTS 7,445,550 B2 * 11/2008 Barney ..... A63F 13/31 446/175
8,814,688 B2 * 8/2014 Barney ..... A63F 13/95 463/40
2007/0197129 A1 * 8/2007 Robinson ..... A63H 3/28 446/484

FOREIGN PATENT DOCUMENTS

| | | | |
|---|---|---|---|
| CN | 2173433 | Y | 8/1994 |
| CN | 101687116 | A | 3/2010 |
| CN | 203253177 | U | 10/2013 |
| CN | 203355301 | U | 12/2013 |
| CN | 205434945 | U | 8/2016 |
| CN | 106139614 | A | 11/2016 |
| CN | 107186722 | A | 9/2017 |
| CN | 206837492 | U | 1/2018 |
| CN | 209019894 | U | 6/2019 |

(Continued)

OTHER PUBLICATIONS

International Search Report and English Translation cited in PCT/CN2020/118088 dated Dec. 31, 2020, 6 pages.

(Continued)

*Primary Examiner* — Nini F Legesse
(74) *Attorney, Agent, or Firm* — Cooper Legal Group, LLC

(57) ABSTRACT

The present disclosure discloses a relay toy for recalling a life course comprising a smart device and a mission-accomplishing relay toy. The smart device is wirelessly connected to the mission-accomplishing relay toy via Bluetooth or Wi-Fi. The mission-accomplishing relay toy comprises a magnetic guiding bar, a ferromagnetic ball, one or more transverse channels, and a plurality of physical levels, and the smart device comprises a plurality of virtual levels corresponding to the plurality of physical levels.

12 Claims, 4 Drawing Sheets

(56) References Cited

FOREIGN PATENT DOCUMENTS

| | | | |
|---|---|---|---|
| CN | 110624258 | A | 12/2019 |
| KR | 101611788 | B1 | 4/2016 |

OTHER PUBLICATIONS

Written Opinion cited in PCT/CN2020/118088 dated Dec. 31, 2020, 4 pages.

* cited by examiner

RELAY TOY FOR RECALLING LIFE COURSE

RELATED APPLICATIONS

This application claims priority to International patent application number PCT/CN2020/118088, filed Sep. 27, 2020, which claims priority to Chinese patent application number 201910930113.4, filed on Sep. 27, 2019. International patent application number PCT/CN2020/118088 and Chinese patent application number 201910930113.4 are incorporated herein by reference.

FIELD OF THE DISCLOSURE

The present disclosure relates to a relay toy for recalling a life course.

BACKGROUND OF THE DISCLOSURE

Due to changes in the living environment, many elderly people lack communication and the ability to speak. If they are not able to find spiritual support for a long time, they are prone to depression, anxiety, and even Alzheimer's disease. A study by a medical expert in the United States found that several years ago, the incidence of Alzheimer's disease for people who started playing with adult educational toys before the age of 50 is only 32% of the general population. Some medical experts have found that for some mild Alzheimer's patients, playing with adult educational toys can slow or even prevent the Alzheimer's disease from deteriorating. A few patients still have a certain degree of intellectual recovery. With the aging trend of the population gradually increasing, there are not many toys specially designed for the elderly. When many people's thinking is still "toys are only for children", a market void for the elderly is regrettable. One of the characteristics of the elderly is to love to recall the good times in the past. How to design a toy suitable for the elderly according to the characteristics of the elderly has become a major problem.

BRIEF SUMMARY OF THE DISCLOSURE

The present disclosure provides a relay toy for recalling a life course to solve the deficiencies in the background.

In order to solve the technical problem, a first technical solution of the present disclosure is as follows.

A relay toy for recalling a life course comprises a smart device, and a mission-accomplishing relay toy. The smart device is wirelessly connected to the mission-accomplishing relay toy via Bluetooth or Wi-Fi. The mission-accomplishing relay toy comprises a magnetic guiding bar, a ferromagnetic ball, one or more transverse channels, and a plurality of physical levels. Each of the plurality of physical levels comprises a controller, a buffer platform, and a plurality of elevating wells. Each of the plurality of elevating wells comprises an elevating rod located inside of a corresponding one of the plurality of elevating wells. A side wall of each of the plurality of elevating wells is disposed with an infrared sensor, and an upper portion of each of the plurality of elevating wells is connected to the buffer platform through an inclined track. The controller is disposed in the buffer platform, and the controller is connected to each of the infrared sensor and the smart device to control the elevating rod. Each of the one or more transverse channels is detachably connected between a corresponding two of the plurality of physical levels. The smart device comprises a plurality of virtual levels and a subject window, and the plurality of virtual levels respectively correspond to the plurality of physical levels. The ferromagnetic ball is configured to be disposed in one of the plurality of elevating wells to enable the infrared sensor to sense the ferromagnetic ball so that the controller is configured to send sensing information to the smart device and a corresponding one of the plurality of virtual levels is configured to flash. When answer information answered according the subject window is correct, the smart device drives the elevating rod of the one of the plurality of elevating wells to be raised through the controller, and the magnetic guiding bar is configured to be used by a user to attract the ferromagnetic ball through the inclined track to slide into another one of the plurality of elevating wells to make the user answer next one of question information, or to slide into next one of the plurality of physical levels.

In a preferred embodiment, the smart device is a mobile phone or a tablet computer.

In a preferred embodiment, the smart device comprises a prompt button configured to provide a prompt about the question information.

In a preferred embodiment, the smart device comprises a help button configured to control the elevating rod to be raised and lowered once.

In a preferred embodiment, two ends of the magnetic guiding bar are respectively disposed with a convex magnet and a concave magnet.

In a preferred embodiment, the inclined track is a circular tube-shaped, inclined track, the one or more transverse channels are circular tube-shaped, transverse channels, and each of an inner diameter of the inclined track and an inner diameter of the one or more transverse channels is larger than a diameter of the ferromagnetic ball.

In a preferred embodiment, the elevating rod is an electric elevating rod driven by a motor, and the controller is connected to the motor to control the electric elevating rod to be raised and lowered.

In a preferred embodiment, each of the plurality of physical levels comprises a first of the plurality of elevating wells comprising an exit for the ferromagnetic ball to enter or exit and a second of the plurality of elevating wells comprising an entrance for the ferromagnetic ball to enter or exit, and each of the one or more transverse channels is detachably connected to a corresponding two of the plurality of physical levels at the exit and the entrance.

In a preferred embodiment, the inclined track is a transparent, circular tube-shaped, inclined track, and the one or more transverse channels are transparent, circular tube-shaped, transverse channels.

In a preferred embodiment, the help button and the prompt button are touch buttons or voice buttons.

Compared with the existing techniques, the technical solution has the following advantages.

1. The user can set up different subjects and question information according to actual needs, such as learning, growth subjects, travel subjects, etc. Different virtual levels can be created according to each of the subjects, and there is certain relevance between these virtual levels. The subjects are connected to one another according to relevance to form a relationship of relay. When the user plays the relay toy, the more levels the user passes, the more subjects to relay, and the better hand-eye coordination and memory retention becomes.

2. The smart device can be a mobile phone or a tablet computer, without the need to purchase additional equipment, saving user costs.

3. The prompt button can be set up, which can be used to prompt users to obtain a prompt of the question information when encountering problems.

4. The help button, through which the user can control a corresponding one of the plurality of elevating wells to be raised and lowered once, can be set up so that the ferromagnetic ball will return to the buffer platform.

5. The convex magnet and the concave magnet are respectively disposed at the two ends of the magnetic guide bar, which can effectively attract the ferromagnetic ball through magnetic force.

6. The inclined track adopts a transparent, circular tube-shaped, inclined track, the one or more transverse channels are transparent, circular tube-shaped, transverse channels, so that the ferromagnetic ball can move in the inclined track and the one or more transverse channels without falling, and it is convenient to observe movement of the ferromagnetic ball.

7. An electric elevating rod can be set to realize lifting.

8. The exit or entrance of the plurality of elevating wells can be used for the ferromagnetic ball to enter and exit and can also be connected by the one or more transverse channels.

9. The smart device is wirelessly connected to the controller via Bluetooth or Wi-Fi to avoid wiring.

DETAILED DESCRIPTION OF THE EMBODIMENTS

The present disclosure will be further described below in combination with the accompanying drawings and embodiments.

Referring to FIGS. 1 to 9, a relay toy for recalling a life course according to the present disclosure comprises a smart device 100 and a mission-accomplishing relay toy 200, and the smart device 100 is wirelessly connected to the mission-accomplishing relay toy 200.

Figure 1:
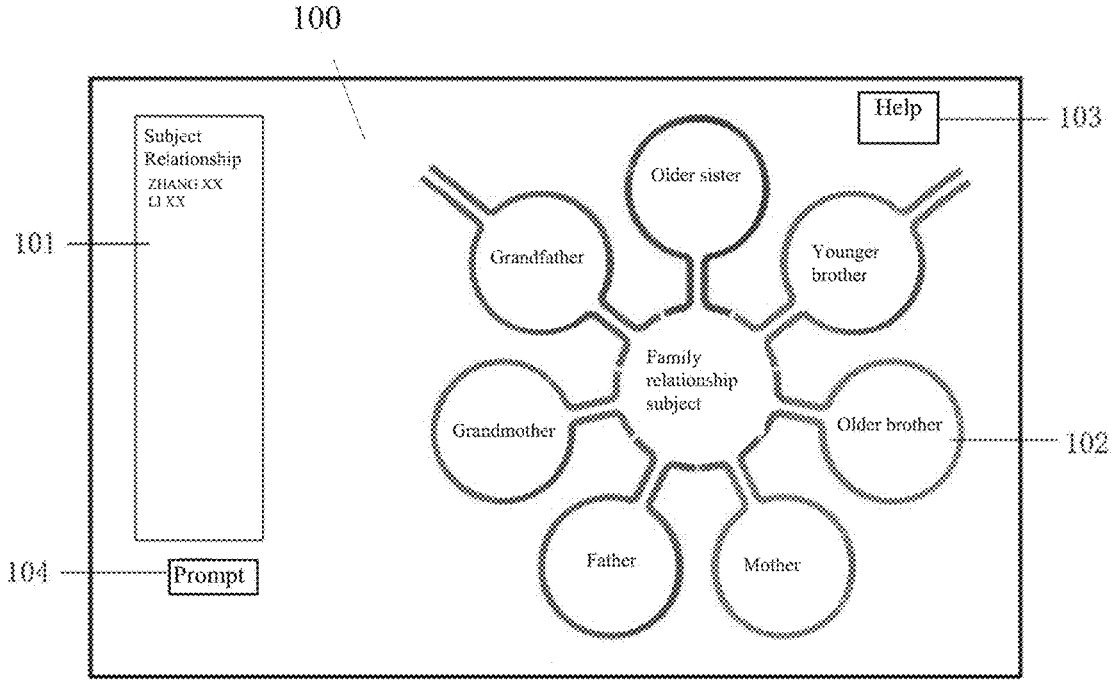
FIG. 1 illustrates a schematic diagram of a smart device in a preferred embodiment of the present disclosure.
Figure 2:
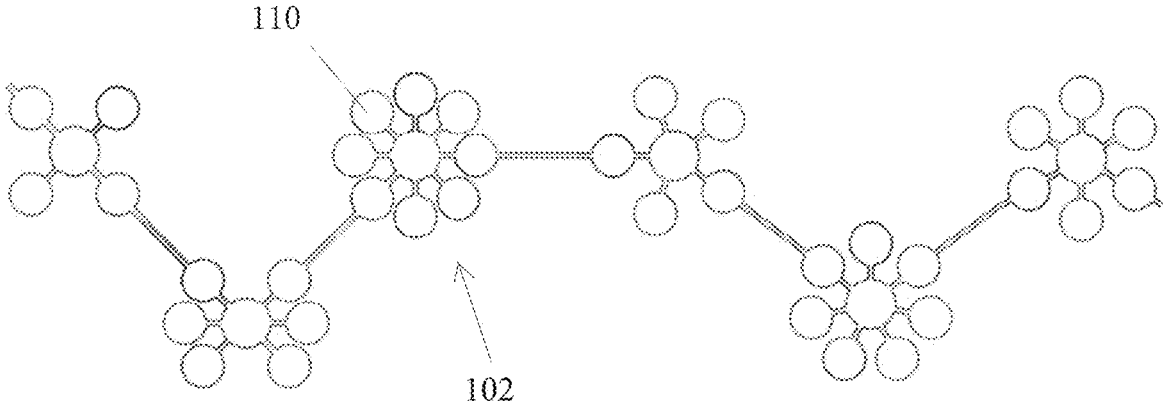
FIG. 2 illustrates a schematic diagram of a plurality of virtual levels in a preferred embodiment of the present disclosure.
Figure 3:
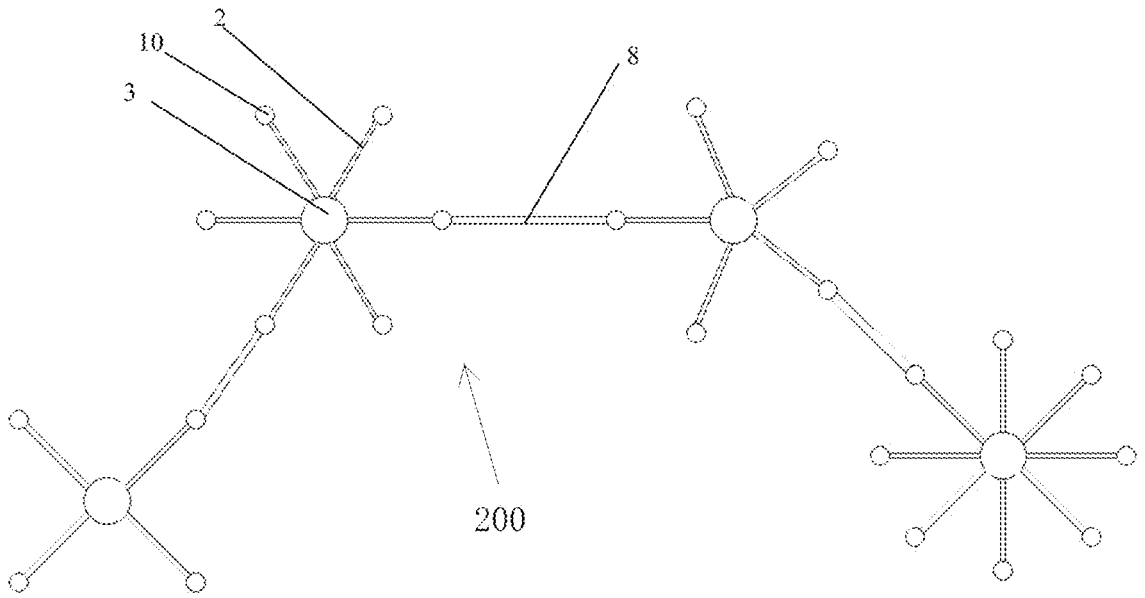
FIG. 3 illustrates a top view of a mission-accomplishing relay toy in a preferred embodiment of the present disclosure.
Figure 4:
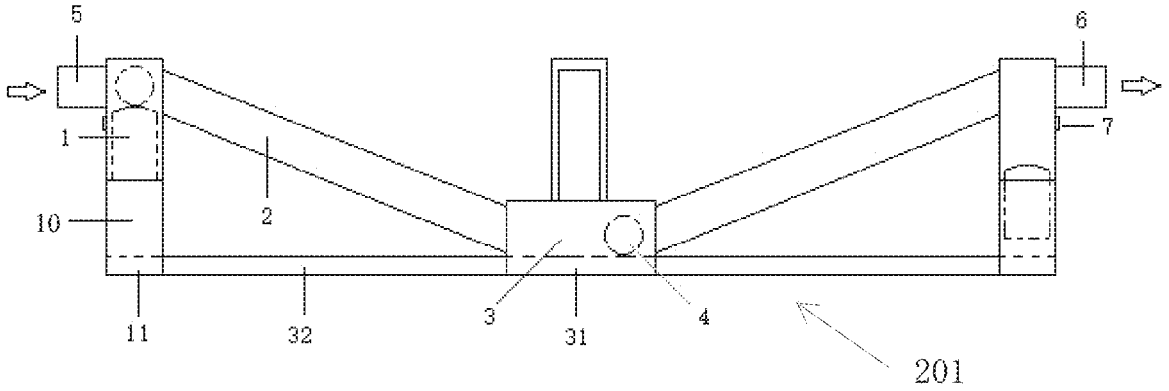
FIG. 4 illustrates a cross-sectional view of each of a plurality of physical levels in a preferred embodiment of the present disclosure.
Figure 5:
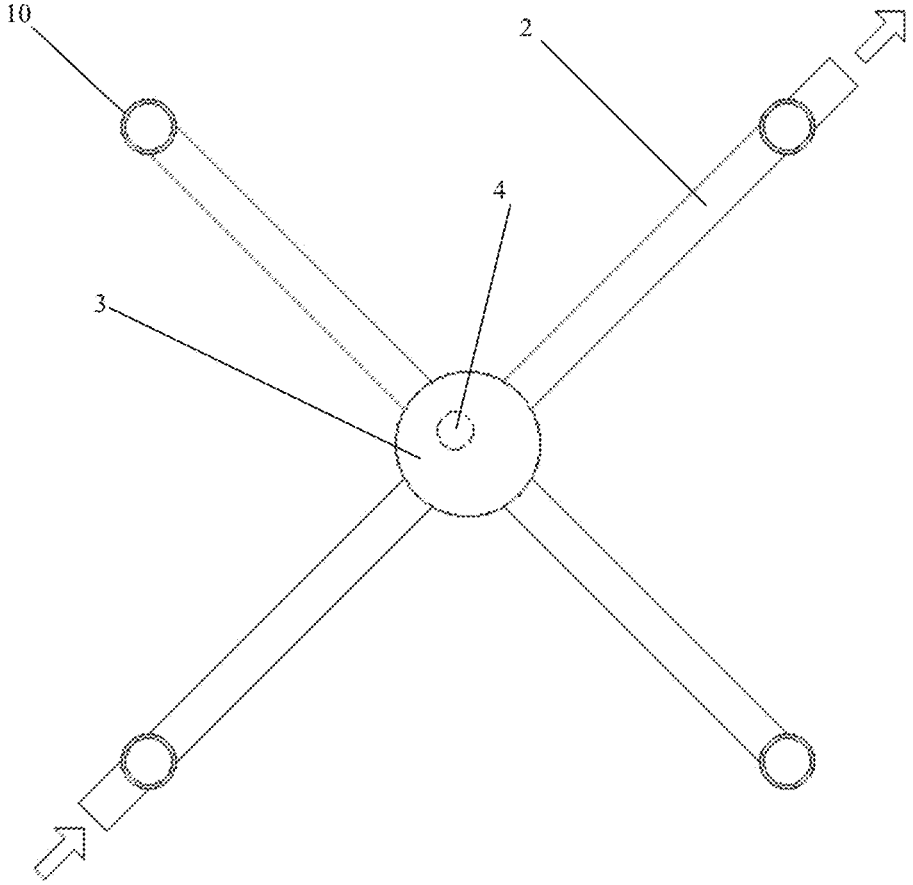
FIG. 5 illustrates is a top view of each of the plurality of physical levels in a preferred embodiment of the present disclosure.
Figure 6:
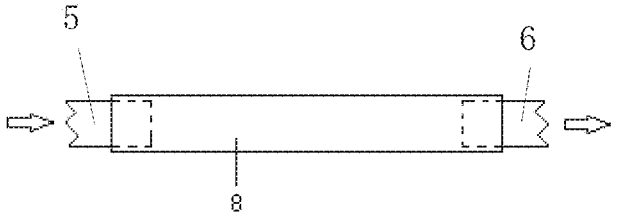
FIG. 6 illustrates a top view of one or more transverse channels in a preferred embodiment of the present disclosure.
Figure 7:
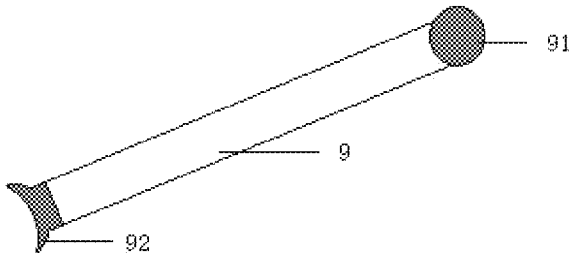
FIG. 7 illustrates a side view of a magnetic guiding bar in a preferred embodiment of the present disclosure.

Referring to FIGS. 1 and 2, the smart device 100 in this embodiment is a tablet computer. The smart device 100 comprises a subject window 101 for displaying content of a subject relationship, a virtual level window 102 for displaying a plurality of virtual levels, a help button 103 for controlling a corresponding one of a plurality of elevating wells 10 to be raised and lowered once, and a prompt button 104 for providing a prompt about question information. The help button 103 and the prompt button 104 may be touch buttons or voice buttons.

Referring to FIGS. 3 to 7, the mission-accomplishing relay toy 200 comprises a magnetic guiding bar 9, a ferromagnetic ball 4, one or more transverse channels 8, and a plurality of physical levels 201. Two ends of the magnetic guiding bar 9 are respectively disposed with a convex magnet 91 and a concave magnet 92.

Each of the plurality of physical levels 201 comprises a controller 31 configured to be wirelessly connected to the smart device 100, a buffer platform 3, and the plurality of elevating wells 10. Each of the plurality of elevating wells 10 comprises an electric elevating rod 1 and a motor 11 located inside of each of the plurality of elevating wells 10, and the motor 11 is configured to drive the electric elevating rod 1. An upper portion of each of the plurality of elevating wells 10 is respectively connected to the buffer platform 3 through an inclined track 2. A side wall of the upper portion of each of the plurality of elevating wells 10 is disposed with an infrared sensor 7 for sensing the ferromagnetic ball 4. The controller 31 is disposed in the buffer platform 3 and is connected to the infrared sensor 7 and the motor 11 through a controlling drive circuit 32. Each of the plurality of physical levels 201 comprises a first of the plurality of elevating wells 10 comprising an exit 6 for the ferromagnetic ball 4 to enter or exit and a second of the plurality of elevating wells 10 comprising an entrance 5 for the ferromagnetic ball 4 to enter or exit. Each of the one or more transverse channels 8 is detachably connected to a corresponding two of the plurality of physical levels 201.

In this embodiment, the inclined track 2 is a transparent, circular tube-shaped, inclined track, and the one or more transverse channels 8 are transparent, circular tube-shaped, transverse channels. Each of an inner diameter of the inclined track 2 and an inner diameter of the one or more transverse channels 8 is larger than a diameter of the ferromagnetic ball 4.

Referring to FIGS. 1 and 2, the virtual level window 102 of the smart device 100 displays the virtual levels corresponding to the plurality of physical levels 201. The smart device 100 can set the question information of each of a plurality of virtual elevating wells 110 of each of the virtual levels in the subject window 101.

Figure 8:
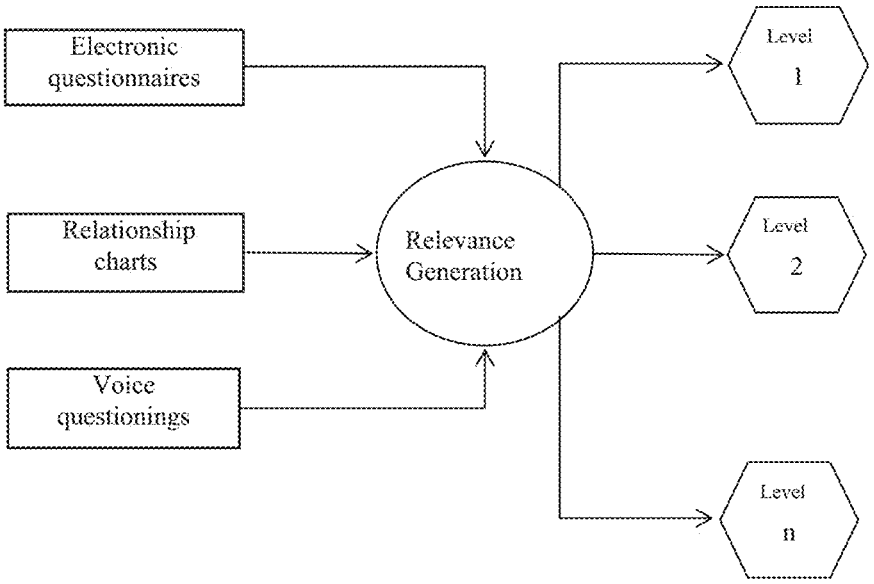
FIG. 8 illustrates a flow chart of generating subjects in a preferred embodiment of the present disclosure.
Figure 9:
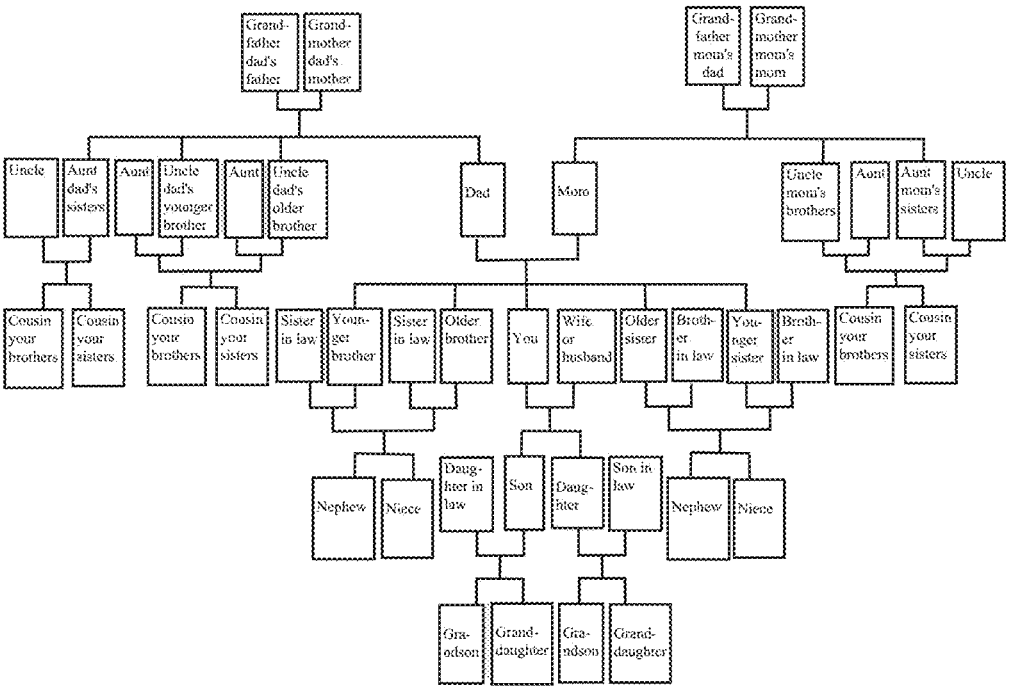
FIG. 9 illustrates a family relationship diagram in a preferred embodiment of the present disclosure.

Referring to FIGS. 8 and 9, the present disclosure can determine a subject of each of the virtual levels and the question information, which is specific, under the subject of each of the virtual levels through electronic questionnaires, relationship charts, and voice questionings. For example, a family relationship subject is determined, and names of different relatives under this subject are to be asked. Please refer to Table 1 for entering the family relationship subject.

TABLE 1

| |
|---|
| Grandfather |
| Grandmother |
| Father |
| Mother |
| Older brother |
| Older sister |
| . . . |

Each of the relatives can enter a name, a child's pet name, a nickname, and the like. That is, one of the question information can have multiple correct answers.

A use method of this embodiment is as follows.

The ferromagnetic ball 4 is put into one of the plurality of elevating wells 10 of a first of the plurality of physical levels 201 through the entrance 5. The infrared sensor 7 senses the ferromagnetic ball 4, and the controller 31 sends sensing information to the smart device 100 to enable the smart device 100 to perceive one of the plurality of virtual elevating wells 110 that corresponds to the one of the plurality of elevating wells 10, and the one of the plurality of virtual elevating wells 110 will flash to prompt a user to fill in (or respond with) answer information. The user fills in (or respond with) the answer information according to the question information in the one of the plurality of virtual elevating wells 110. For example, under a condition that the question information in the family relationship subject is the father's name, when the answer information is wrong, the one of the plurality of virtual elevating wells 110 will continue to flash until the answer information is correct. When the user encounters difficulties in answering the question information, the user can ask for help through the help button 103 and the prompt button 104. When the answer information, which is the name of the father, is filled in correctly, the smart device 100 sends a message to drive the electric elevating rod 1 of a corresponding one of the plurality of elevating wells 10 to be raised through the controlling drive circuit 32 of the controller 31, and the ferromagnetic ball 4 slides down to the buffer platform 3 through the inclined track 2.

The user uses the magnetic guiding bar 9 to attract the ferromagnetic ball 4 through the inclined track 2 to slide into another one of the plurality of elevating wells 10. When the question information of another one of the plurality of elevating wells 10 is answered correctly, the ferromagnetic ball 4 can enter the next one of the plurality of physical levels 201 through the one or more transverse channels 8. The electric elevating rod 1 of the first of the plurality of elevating wells 10, that has the exit 6, of a last one of the plurality of physical levels 201 is configured be raised when the others of the plurality of physical levels 201 have be completed, and the ferromagnetic ball 4 can be taken out from the exit of the last one of the plurality of physical levels 201 when all of the plurality of physical levels 201 have been completed.

In addition to the question information relative to the family relationship subject, the user can set up different subjects and question information according to actual needs, such as learning, growth subjects, travel subjects, etc. Different virtual levels can be created according to each of the subjects, and there is certain relevance between these virtual levels. The subjects are connected to one another according to relevance to form a relationship of relay. When the user plays the relay toy, the more levels the user passes, the more subjects to relay, and the better hand-eye coordination and memory retention becomes. The relay toy can help the elderly recall their life course, and a difficulty level of the relay toy be adjusted by setting the number of physical levels.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A relay toy for recalling a life course, comprising:
a smart device, and
a mission-accomplishing relay toy, wherein:
the smart device is wirelessly connected to the mission-accomplishing relay toy via Bluetooth or Wi-Fi,
the mission-accomplishing relay toy comprises a magnetic guiding bar, a ferromagnetic ball, one or more transverse channels, and a plurality of physical levels,
each of the plurality of physical levels comprises a controller, a buffer platform, and a plurality of elevating wells,
each of the plurality of elevating wells comprises an elevating rod located inside of a corresponding one of the plurality of elevating wells,
a side wall of each of the plurality of elevating wells is disposed with an infrared sensor,
an upper portion of each of the plurality of elevating wells is connected to the buffer platform through an inclined track,
the controller is disposed in the buffer platform,
the controller is connected to each of the infrared sensor and the smart device to control the elevating rod,
each of the one or more transverse channels is detachably connected between a corresponding two of the plurality of physical levels,
the smart device comprises a plurality of virtual levels and a subject window,
the plurality of virtual levels respectively corresponds to the plurality of physical levels,
the ferromagnetic ball is configured to be disposed in one of the plurality of elevating wells to enable the infrared sensor to sense the ferromagnetic ball so that the controller is configured to send sensing information to the smart device and a corresponding one of the plurality of virtual levels is configured to flash, and
when answer information answered according the subject window is correct:
the smart device drives the elevating rod of the one of the plurality of elevating wells to be raised through the controller, and
the magnetic guiding bar is configured to be used by a user to attract the ferromagnetic ball through the inclined track to slide into another one of the plurality of elevating wells to make the user answer next one of question information or to slide into next one of the plurality of physical levels.

2. The relay toy for recalling the life course according to claim 1, wherein:
the smart device is a mobile phone or a tablet computer.

3. The relay toy for recalling the life course according to claim 1, wherein:
the smart device comprises a prompt button configured to provide a prompt about the question information.

4. The relay toy for recalling the life course according to claim 3, wherein:
the prompt button is a touch button or a voice button.

5. The relay toy for recalling the life course according to claim 1, wherein:
the smart device comprises a help button configured to control the elevating rod to be raised and lowered once.

6. The relay toy for recalling the life course according to claim 5, wherein:
the help button is a touch button or a voice button.

7. The relay toy for recalling the life course according to claim 1, wherein:

two ends of the magnetic guiding bar are respectively disposed with a convex magnet and a concave magnet.

8. The relay toy for recalling the life course according to claim 1, wherein:

the inclined track is a circular tube-shaped, inclined track, the one or more transverse channels are circular tube-shaped, transverse channels, and each of an inner diameter of the inclined track and an inner diameter of the one or more transverse channels is larger than a diameter of the ferromagnetic ball.

9. The relay toy for recalling the life course according to claim 8, wherein:

the circular tube-shaped, inclined track is transparent and the circular tube-shaped, transverse channels are transparent.

10. The relay toy for recalling the life course according to claim 1, wherein:

the elevating rod is an electric elevating rod driven by a motor, and the controller is connected to the motor to control the electric elevating rod to be raised and lowered.

11. The relay toy for recalling the life course according to claim 1, wherein:

each of the plurality of physical levels comprises a first of the plurality of elevating wells comprising an exit for the ferromagnetic ball to enter or exit and a second of the plurality of elevating wells comprising an entrance for the ferromagnetic ball to enter or exit, and each of the one or more transverse channels is detachably connected to a corresponding two of the plurality of physical levels at the exit and the entrance.

12. The relay toy for recalling the life course according to claim 1, wherein:

the inclined track is a transparent, circular tube-shaped, inclined track, and the one or more transverse channels are transparent, circular tube-shaped, transverse channels.

* * * * *